United States Patent [19]

Benasutti

[11] 4,196,957

[45] Apr. 8, 1980

[54] CIRCUIT BOARD CONNECTOR

[75] Inventor: John E. Benasutti, Oil City, Pa.

[73] Assignee: GTE Sylvania Incorporated, Stamford, Conn.

[21] Appl. No.: 914,642

[22] Filed: Jun. 12, 1978

[51] Int. Cl.[2] ..... H01R 13/10

[52] U.S. Cl. ..... 339/176 M; 339/17 LC; 339/18 C

[58] Field of Search ..... 339/17 C, 17 LC, 18 C, 339/176 M, 176 MP

[56] References Cited

U.S. PATENT DOCUMENTS

| | | | |
|---|---|---|---|
| 3,493,916 | 2/1976 | Hansen | 339/176 M |
| 3,667,045 | 5/1972 | Combs | 339/17 LC |
| 4,070,084 | 1/1978 | Hutchison | 339/176 M |

*Primary Examiner*—Joseph H. McGlynn
*Attorney, Agent, or Firm*—Robert E. Walter

[57] ABSTRACT

An electrical connector comprises an insulating body having an external surface with an area on the surface provided for abutting a printed wiring board. A plurality of contacts are internal the insulating body with at least a few of the contacts extending to the area. Leads extending outwardly from the surface are at a location exterior the area. A plurality of conductive paths on the surface provide electrical connection between the contacts and respective leads whereby a portion of the surface is unobstructed by contact tails for abutting the edge of the printed wiring board. The surface itself may be formed as part of a printed wiring board.

11 Claims, 4 Drawing Figures

CIRCUIT BOARD CONNECTOR

BACKGROUND OF THE INVENTION

The present invention relates to a connector of the type which is utilized for providing electrical connection to a printed wiring board from electrical conductors wherein a quick disconnect is provided between the conductors and the connector.

A connector of this type is described in U.S. Pat. No. 3,697,933 to Black et al. wherein a two row block for mounting on a circuit board is disclosed. The block includes two rows of female terminals extending parallel to the circuit board. A contact tail of each terminal is in electrical connection with the circuit board. The connector block is mounted with a bottom surface thereof adjacent a flat face of the circuit board. The contact tails extending perpendicular to the terminals extend through the bottom surface and into appropriate connection with the circuit board.

U.S. Pat. No. 3,696,319 to Olsson relates to a flat conductor cable connector having a bottom surface mounted on one side of a circuit board. Terminals within the connector block include tail portions extending exterior to a side wall of the connector block in a direction generally parallel with the surface of the circuit board. The tails are bent downwardly toward the circuit board to make connection therewith.

Conventional connector blocks generally rest directly on one of the planar surfaces of a circuit board. This feature not only utilizes space that might more appropriately be used but unduly limits the spacing of adjacently mounted printed wiring boards.

SUMMARY OF THE INVENTION

Accordingly, it is an object of the present invention to provide a new and improved connector utilizing minimal printed wiring board space and mounting space associated with the boards.

According to a preferred embodiment, the connector can be mounted on the edge of a printed wiring board thus freeing the planar surfaces of the circuit board for use in electrical circuitry and minimizing the space required for mounting adjacent printed wiring boards.

Other and further objects of the present invention will become apparent from the following description.

In accordance with principles of the present invention, there is provided an electrical connector for mounting on a printed wiring board comprising an insulating body having an external surface, an area on said surface being provided for abutting a printed wiring board, a plurality of contacts internal said insulating body, at least of few of said contacts extending to said area, a plurality of leads extending outwardly from said surface at a location exterior said area, a plurality of conductive paths on said surface for providing electrical connection between said contacts and respective leads.

DETAILED DESCRIPTION

Figure 1:
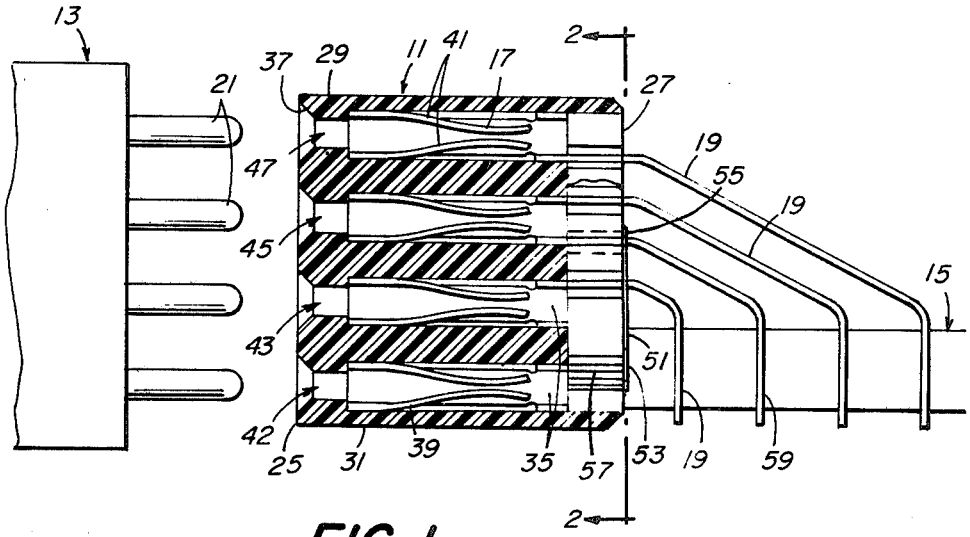
FIG. 1 is a side elevational view along section 1—1 of FIG. 2.
Figure 3:
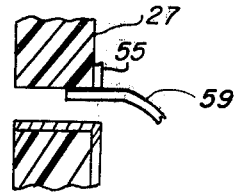
FIG. 3 is an enlarged partial sectional view along line 3—3 of FIG. 2.
Figure 4:
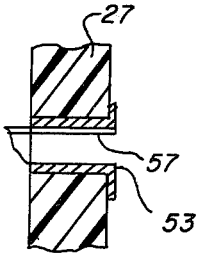
FIG. 4 is an enlarged partional sectional view along line 4—4 of FIG. 2.
Figure 2:
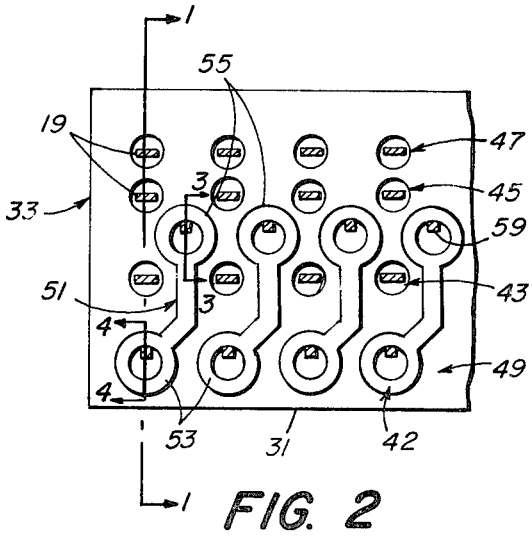
FIG. 2 is a partial end view along section 2—2 of FIG. 1.

As illustrated in FIG. 1, connector 11 is the female type having a plurality of disconnect contacts 17 therein. The connector 11 makes electrical connection with the printed wiring board 15 by a plurality of contact tails 19. The circuit board 15 is of a conventional type comprising a substrate having a plurality of holes located therein. The holes lie in a substantially common plane and are clad in copper or other electrically conducting material. Electrically conductive strips may be placed on the board to provide appropriate electrical connection to a selected plated through holes.

The female disconnect contacts 17 are positioned within the connector 11 whereby they may be appropriately mated with male contacts 21 mounted on plug 13. Terminals 21 may be removably inserted into the disconnect contacts 17 so that conductors may be removably connected to the circuit board via connector 11.

The connector is a generally rectangular body formed from an insulating material having external surfaces including a front surface 25, a rear surface 27, top surface 29, bottom surface 31 and a pair of side surfaces, one of which is illustrated at 33. The front surface 25 and rear surface 27 are substantially parallel. The disconnect terminals 17 are positioned within a plurality of cavities 35 which extend from front surface 25 in a widthwise direction substantially perpendicular or normal to the front surface 25. The contacts 17 are longitudinally aligned in the cavities 35. The cavities 35 which interpose the sides form lengthwise extending rows that are substantially parallel to the top surface 29 and bottom surface 31. The cavities 35 communicate with front surface 25 through beveled openings 37.

The female disconnect contacts 17 are fitted interior the cavities 35. Each of the contacts 17 have U-shaped sections at either end thereof which are in engagement with the interior surface of respective cavities 35. Intermediate the ends, each of the contacts 17 include bowed portions 41 for providing a gripping engagement with the contacts 21 of plug 13.

The cavities 35 with contacts 17 and contacts 39 therein are arranged in substantially parallel rows 42, 43, 45 and 47 which are interposed with the sides. The first row 42 is adjacent bottom surface 31 and a second row 43 is positioned immediately above the first row 42. Similarly, third row 45 and fourth row 47 are positioned immediately above the proceding row.

The surface 27 is preferably formed as a face of a printed wiring board which is fitted into a recess in the insulating body. The surface or printed wiring board face 27 includes an area or portion 49 of the surface 27 for abutting the edge or side surfaces of a printed wiring board 15 which is hereinafter referred to as main printed wiring board 15. The main board 15 includes side surfaces which meet the parallel faces thereof. The area 49 is unobstructed by contact tails which would interfere with the mounting of the connector 11 on the edge or side surfaces of a main printed wiring board 15.

A few of the contacts or those contacts 39 in the first row 42 have contact tails which extend to the surface 27 along a direction substantially normal to the surface 27. The contacts or tail portions 57 thereof terminate at the surface 27 interior the area 49 which is provided for abutting a main board 15. At the junction of the tail portions 57 and the surface 27, the tails 57 are connected to conductive paths 51 on the surface of the printed wiring board 27.

A plurality of leads 59 are mounted on the insulating body at openings 55 so as to extend outwardly from surface 27 at a location exterior area 49. The conductive paths 51 provide electrical connection between respective contacts 17 and leads 59. Each of the conductive paths 51 extend from their respective junctions with contacts 39 internal the area 49 to their respective junctions with the leads 59 exterior the area 49. The junctions referred to can be formed by soldering the leads 59 and the tails 57 to through plated holes 53 and 55 located at the ends of the paths 51.

The remaining group of contacts 17, those in the second through fourth row, 43, 45 and 47, have contact tails 19 which extend outwardly from surface 27. As illustrated in FIG. 1, surface 27 is formed as a printed wiring board with the contact tails 19 extending outwardly of surface 27 through openings therein. Internal the insulating body the tails 19 extend substantially normal to the rear surface 27. External to the rear surface 27, the contact tails 17 are bent at an angle and extend to respective openings in the main printed wiring board 15.

The contact tails 19 of the second, third and fourth rows, 43, 45, 47, form first, second and third tiers of contact tails 19 which extend lengthwise forming respective tiers that are substantially parallel. The leads 59 form a fourth tier intermediate the second and third tiers of contact tail 19. The fourth tier is staggered with respect to the third tier of contact tails 19 and the conductive paths 51 extend juxtaposed thereto.

In operation, the abutting surface 49 is mounted to the edge of the main wiring board 15. The leads 59 and tails 19 are connected to holes in the main board 15. Electrical connection with the main board 15 is then made by inserting plug 13 into the female terminal 11. The connector 11 provides for high density connection to the main printed wiring board 15.

While the invention has been described with reference to a preferred embodiment, it is to be understood that various changes and modifications may be made by those skilled in the art without departing from the spirit and concept of the invention, the scope of which is to be determined by reference to the following claims.

What is claimed is:

1. An electrical connector for mounting on a printed wiring board comprising an insulating body having an external surface, an area on said surface being provided for abutting a printed wiring board, a plurality of contacts internal of said insulating body, at least a few of said contacts extending to said area, a plurality of leads extending outwardly from said surface at a location exterior said area, a plurality of conductive paths on said surface for providing an electrical connection between said contacts and respective leads.

2. An electrical connector according to claim 1 wherein said surface is formed as a face of a printed wiring board.

3. An electrical connector according to claim 1 wherein a remaining group of said contacts include contact tails extending outwardly of said surface at a location exterior said area.

4. An electrical connector according to claim 1 wherein said surface comprises a face of a printed wiring board, said board having a plurality of openings therein, said remaining group of contacts having tails extend outwardly of said surface through said openings.

5. An electrical connector according to claim 1 wherein said surface comprises a rear surface, said body includes a front surface space from said rear surface and substantially parallel thereto, a plurality of cavities communicating with said front surface, said contacts being within respective cavities and extending longitudinally substantially normal to said front surface.

6. An electrical connector according to claim 5 wherein said insulating body includes top and bottom surfaces, said cavities extending widthwise through said insulating housing and being arranged in substantially parallel rows extending lengthwise, said rows being substantially parallel to said bottom surface.

7. An electrical connector according to claim 6 wherein one row is adjacent said bottom surface, said row adjacent said bottom surface having contacts terminating to conductive paths within said area.

8. A female contact connector of the type adapted to be mounted on a printed wiring board and providing disconnect with male contacts comprising, an insulating body having a top surface, a bottom surface, a pair of side surfaces and substantially parallel front and rear surfaces, a plurality of cavities extending widthwise through said insulating body in a direction substantially normal to said front surface for communicating therewith, a plurality of female contacts extending longitudinally of said cavities, said cavities with contacts therein being arranged in substantially parallel rows interposed said sides, said rows including a first row adjacent said bottom surface, second row immediately above said first row, a third row immediately above said second row and a fourth row immediately above said third row, at least a portion of said contacts included in said second, third and fourth rows including contact tails extending outwardly of said rear surface, said contacts of said first row having tails terminating on said rear surface, a plurality of leads extending outwardly of said rear surface intermediate said second and third rows of contact tails, a plurality of conductive paths on said rear surface, for providing electrical connection between respective tails of contacts of said first row and respective leads.

9. A female contact connector according to claim 8 wherein said leads are staggered with respect to said contact tails of said third row.

10. A female contact connector according to claim 9 wherein said conductive paths extend juxtaposed said contact tails of said third row.

11. A female contact connector according to claim 10 wherein said surface is formed as a face of a printed wiring board.

* * * * *